US011166616B2

(12) United States Patent
Eisenbart et al.

(10) Patent No.: US 11,166,616 B2
(45) Date of Patent: Nov. 9, 2021

(54) DOMESTIC DISHWASHER

(71) Applicant: BSH Hausgeräte GmbH, Munich (DE)

(72) Inventors: Bernd Eisenbart, Holzheim (DE); Michael Lugert, Jettingen-Scheppach (DE); Werner Oblinger, Mödingen (DE); Bernd Heisele, Sontheim (DE); Anton Oblinger, Wertingen (DE)

(73) Assignee: BSH Hausgeräte GmbH, Munich (DE)

( * ) Notice: Subject to any disclaimer, the term of this patent is extended or adjusted under 35 U.S.C. 154(b) by 37 days.

(21) Appl. No.: 16/640,071

(22) PCT Filed: Sep. 12, 2018

(86) PCT No.: PCT/EP2018/074542
§ 371 (c)(1),
(2) Date: Feb. 19, 2020

(87) PCT Pub. No.: WO2019/063282
PCT Pub. Date: Apr. 4, 2019

(65) Prior Publication Data

US 2020/0221920 A1 Jul. 16, 2020

(30) Foreign Application Priority Data

Sep. 29, 2017 (DE) ..... 10 2017 217 382.3

(51) Int. Cl.
*A47L 15/42* (2006.01)

(52) U.S. Cl.
CPC ..... *A47L 15/428* (2013.01)

(58) Field of Classification Search
CPC ..... A47L 15/16; A47L 15/18; A47L 15/20; A47L 15/22; A47L 15/23; A47L 15/428; A47L 15/4282
See application file for complete search history.

(56) References Cited

U.S. PATENT DOCUMENTS 1,916,806 A 7/1933 Myrick
2,614,886 A * 10/1952 Dewdney ..... A47L 15/428 239/221

(Continued)

FOREIGN PATENT DOCUMENTS

| | | | |
|---|---|---|---|
| EP | 1232720 | A2 | 8/2002 |
| JP | H09164105 | A | 6/1997 |
| JP | 2004236963 | A | 8/2004 |

OTHER PUBLICATIONS

National Search Report DE 10 2017 217 382.3 dated Jun. 5, 2018.
International Search Report PCT/EP2018/074542 dated Nov. 20, 2018.

*Primary Examiner* — David G Cormier
(74) *Attorney, Agent, or Firm* — Michael E. Tschupp; Andre Pallapies; Brandon G. Braun

(57) ABSTRACT

A household dishwasher includes a washing container, and a spray facility arranged within the washing container for spraying washing liquor and/or fresh water in the washing container. The spray facility includes a cage, a gyro element rotatably supported in the cage, and a supply line having a nozzle for supplying the washing liquor and/or fresh water to the gyro element. The gyro element is arranged in its entirety above the nozzle in relation to a direction of gravity in an operating position which the gyro element assumes when washing liquor and/or fresh water is supplied to the gyro element.

18 Claims, 8 Drawing Sheets

(56) References Cited

U.S. PATENT DOCUMENTS

| | | | | |
|---|---|---|---|---|
| 3,368,573 | A * | 2/1968 | Mixon | A47L 15/23 134/176 |
| 5,673,714 | A | 10/1997 | Campagnolo et al. | |
| 5,697,392 | A | 12/1997 | Johnson et al. | |
| 2009/0145981 | A1 | 6/2009 | Mack et al. | |
| 2010/0116301 | A1 | 5/2010 | Heisele et al. | |
| 2012/0291827 | A1* | 11/2012 | Buddharaju | A47L 15/428 134/198 |
| 2014/0216507 | A1 | 8/2014 | Pyo | |
| 2015/0366430 | A1* | 12/2015 | Ross | A47L 15/428 134/169 R |

* cited by examiner

DOMESTIC DISHWASHER

CROSS-REFERENCES TO RELATED APPLICATIONS

This application is the U.S. National Stage of International Application No. PCT/EP2018/074542, filed Sep. 12, 2018, which designated the United States and has been published as International Publication No. WO 2019/063282 A1 and which claims the priority of German Patent Application, Serial No. 10 2017 217 382.3, filed Sep. 29, 2017, pursuant to 35 U.S.C. 119(a)-(d).

BACKGROUND OF THE INVENTION

The present invention relates to a household dishwasher.

A dishwasher can have a washing container and spray facilities arranged in the washing container for spraying items being washed with washing liquor and/or fresh water. Such a spray facility can for example be mounted at the top of the washing container, in particular in the manner of what is referred to as a top gyro.

WO 2008/125474 A1 describes a dishwasher with a hydraulic unit and at least one top spray facility, which is arranged above a rack for items being washed and can be supplied with washing liquor by means of the hydraulic unit and which has a rotatable spray head, which is fastened to the hydraulic unit by means of a cage. The spray head here is supported in a rotatable manner in the cage.

EP 1 232 720 A2 describes a spray facility for distributing washing liquid in a dishwasher. The spray facility has at least one fixed spray nozzle and at least one movably supported diffusion apparatus assigned to the spray nozzle.

BRIEF SUMMARY OF THE INVENTION

Against this background one object of the invention is to provide an improved household dishwasher.

A household dishwasher is proposed accordingly. The household dishwasher comprises a washing container and at least one spray facility arranged within the washing container for spraying washing liquor and/or fresh water in the washing container, the spray facility comprising a cage, a gyro element rotatably supported in the cage and a supply line with a nozzle for supplying the washing liquor and/or fresh water to the gyro element. When the gyro element is in its operating position, which it assumes at least when washing liquor and/or fresh water is supplied to it, it is arranged in its entirety above the nozzle in relation to a direction of gravity.

Because the gyro element is arranged above the nozzle in relation to the direction of gravity at least in its operating position, the spray facility can be used to spray receptacles for items being washed arranged in the washing container or items being washed held in the receptacles for such items from below. This produces an improved cleaning result. The washing liquor and/or fresh water can be distributed in the washing container in particular in the form of a hemispherical spray pattern with the aid of the rotatably supported gyro element. The rotatable support for the gyro element improves the cleaning result further.

According to the invention, when the gyro element is in its operating position it is arranged in its entirety above the nozzle, meaning that all the elements and/or regions of the gyro element are arranged above the nozzle in relation to the direction of gravity. This results in clearance at every point between the nozzle and the gyro element during operation of the gyro element, allowing the passage of dirt particles and thus counteracting failure or malfunction due to soiling. The clearance here refers to the width and/or height of a gap resulting between two adjoining parts of the nozzle on the one hand and the gyro element on the other hand. The clearance between nozzle and gyro element when the gyro element is in the operating position is at least 3 mm, preferably at least 4 mm and particularly preferably at least 5 mm. This means that the spray facility is embodied in a soiling-resistant manner.

The gyro element is arranged in particular within the cage and supported thereon. The nozzle is preferably designed to spray the washing liquor and/or fresh water onto the gyro element under pressure counter to the direction of gravity. In other words, during operation of the household dishwasher the washing liquor and/or fresh water is sprayed onto the gyro element counter to the direction of gravity with the aid of the nozzle, causing said gyro element to be raised into its operating position counter to the direction of gravity and to be made to rotate. This causes the washing liquor to be distributed in the washing container. The spray facility can be fastened for example in a fixed manner to the washing container or a receptacle for items being washed held in the washing container. In particular the spray facility can be provided on a base of the washing container. The spray facility can also be arranged on a spray arm supported rotatably on or in the washing container. A plurality of spray facilities is preferably provided. The supply line and the nozzle are preferably provided in or on a housing of the spray facility. The cage is preferably fastened to the housing. Alternatively the cage can also be configured as a single material piece with the housing. The supply line can also be configured as a single piece with the cage. In other words the cage can comprise the supply line or vice versa.

Embodiments are also possible, in which the gyro element is also arranged in its operating position without the action of the sprayed washing liquor and/or fresh water. This can be achieved with a corresponding structural design. However embodiments, in which the gyro element is only raised into its operating position by the action of the sprayed washing liquor and/or fresh water, have the advantage of a particularly simple structure and a further improved possibility of cleaning, in particular the bearing points, in the rest position.

According to one embodiment of the invention just one nozzle is provided, which is designed to spray the washing liquor and/or fresh water onto the center of the gyro element.

To this end the nozzle can be provided centrally below the gyro element. In particular the nozzle can be arranged centrally in relation to a rotation axis of the gyro element. However the nozzle can also be positioned with an offset in relation to the gyro element or to the rotation axis. The nozzle is realized in that there is a narrowing of the cross section on the supply line. In other words the nozzle is a narrowing of the cross section on the supply line. This increases the pressure of the washing liquor and/or fresh water sprayed with the aid of the nozzle.

According to a further embodiment the gyro element has a curved outer contour, in particular one curved in the manner of a spherical cap.

The outer contour is preferably provided on blades of the gyro element. The spherical cap-shaped outer contour is manifested when the gyro element rotates about its rotation axis. In other words the outer contour is an envelope, in particular an enveloping surface, preferably a three-dimensional enveloping curve, of the rotating gyro element. A spherical cap, a spherical segment or a spherical section is part of a spherical body formed by a section with one plane.

Such a spherical cap has the shape of a cupola and has a circular disk-shaped footprint.

According to a further embodiment the cage is curved, in particular curved in the manner of a spherical cap.

In other words the cage is configured in a corresponding manner to the gyro element. This makes the spray facility particularly compact. Alternatively the cage and/or gyro element can have a different geometry. The cage preferably has a number of bars, which are connected to one another on a bearing plate of the cage. The gyro element is in turn rotatably supported on the bearing plate. To this end the bearing plate has an axle, which is held rotatably in a central holding segment of a hub of the gyro element. Alternatively the hub of the gyro element can also comprise the axle, which is then held rotatably in a holding segment configured in the bearing plate. To keep the size of the spray facility as small as possible, it is expedient with such an embodiment to reduce the material thickness of the bearing plate and therefore of the cage in the region above the holding segment (in relation to the direction of gravity) compared with the adjacent regions of the bearing plate.

According to a further embodiment the gyro element has a hub and blades connected to the hub, the hub being designed to supply the washing liquor and/or fresh water supplied with the aid of the supply line to the blades during operation of the household dishwasher.

The hub and blades are preferably configured as a single material piece. The gyro element is preferably a single-piece plastic part, in particular an injection-molded plastic part. The gyro element is made to rotate with the aid of the blades when the washing liquor and/or fresh water is sprayed onto the hub. This distributes the washing liquor and/or fresh water around the spray facility. This in particular produces a spherical spray pattern, which improves the cleaning result.

According to a further embodiment the hub is configured with rotational symmetry in relation to a rotation axis of the gyro element and has a conical lateral surface.

The hub preferably does not have the geometry of a truncated cone, rather a conical geometry with a cone tip or tip. A half taper angle or taper angle of the lateral surface can be for example 30° to 60°, more preferably 40° to 50°, more preferably 45°. The washing liquor and/or fresh water is supplied to the blades along the conical lateral surface. The spray pattern of the spray device can be freely defined by varying the geometry of the lateral surface, in other words the size of the taper angle. It is possible to generate an almost completely full hemispherical spray pattern around the spray facility with widely differing taper angles of the gyro element and rotation thereof.

According to a further embodiment the lateral surface is configured with a number of steps and has a number of lateral surface segments, which differ from one another in respect of their taper angles.

For example a first lateral surface segment is provided with a first half taper angle or first taper angle and a second lateral surface segment is provided with a second half taper angle or second taper angle. The second taper angle is preferably greater than the first taper angle. A circular cylinder-shaped lateral surface segment can also be provided between the conical lateral surface segments.

According to a further embodiment the hub is configured asymmetrically in relation to a rotation axis of the gyro element so that a spray angle of the spray facility varies during operation of the household dishwasher.

This results in chaotic distribution of the washing liquor and/or fresh water. This produces an even better cleaning result. In this instance the hub preferably has a lateral surface which is not configured with rotational symmetry in relation to the rotation axis. The lateral surface can have segments with different angles of inclination. The lateral surface can also be a free-form surface.

According to a further embodiment the blades are angled at an angle of inclination relative to the rotation axis.

The angle of inclination can be for example 20° to 60°, preferably 30° to 50°, more preferably 35° to 45°, more preferably 40°. The blades can also have a rounded or curved shape when viewed in a radial direction of the gyro element. The radial direction is oriented in particular perpendicular to the rotation axis and away from it.

According to a further embodiment the blades are connected to one another with the aid of a connecting ring running around the gyro element.

The hub, blades and connecting ring are preferably a single material piece part, in particular an injected-molded plastic part.

A freely definable spray pattern can be achieved according to the selected taper angle of the hub with the aid of the structural configuration of the hub and blades. Different taper angles and/or the above-mentioned asymmetric configuration of the hub allow(s) a completely full hemispherical spray pattern to be generated around the spray facility. The mode of operation of the spray facility is clearly obvious in particular visually for a user of the household dishwasher and the added value of the spray facility is easy to comprehend. The spray facility is soiling-resistant due to a sufficiently large bearing clearance in the axial and radial directions and a sufficiently large bearing gap configuration between the axle and the holding segment, in which the axle is rotatably held. This is true both of embodiments in which the axle is configured on the bearing plate and therefore on the cage and also embodiments in which the axle is configured on the hub and therefore on the gyro element. Even if the gyro element should be blocked, there is a highly effective fail-safe response, as the hub alone distributes the washing liquor/fresh water adequately. Its spherical cap-shaped geometry means that the spray facility is compact and can therefore be positioned below the receptacles for items being washed.

Further possible implementations of the household dishwasher comprise combinations of features or embodiments described above or in the following with regard to the exemplary embodiments even if these are not cited specifically. The person skilled in the art will also add individual aspects to improve or complete the respective basic form of the household dishwasher.

BRIEF DESCRIPTION OF THE DRAWINGS

Further advantageous configurations and aspects of the household dishwasher are set out in the subclaims and the exemplary embodiments of the household dishwasher described in the following. The household dishwasher is also described in more detail based on preferred embodiments with reference to the accompanying figures.

DETAILED DESCRIPTION OF EXEMPLARY EMBODIMENTS OF THE PRESENT INVENTION

Figure 1:
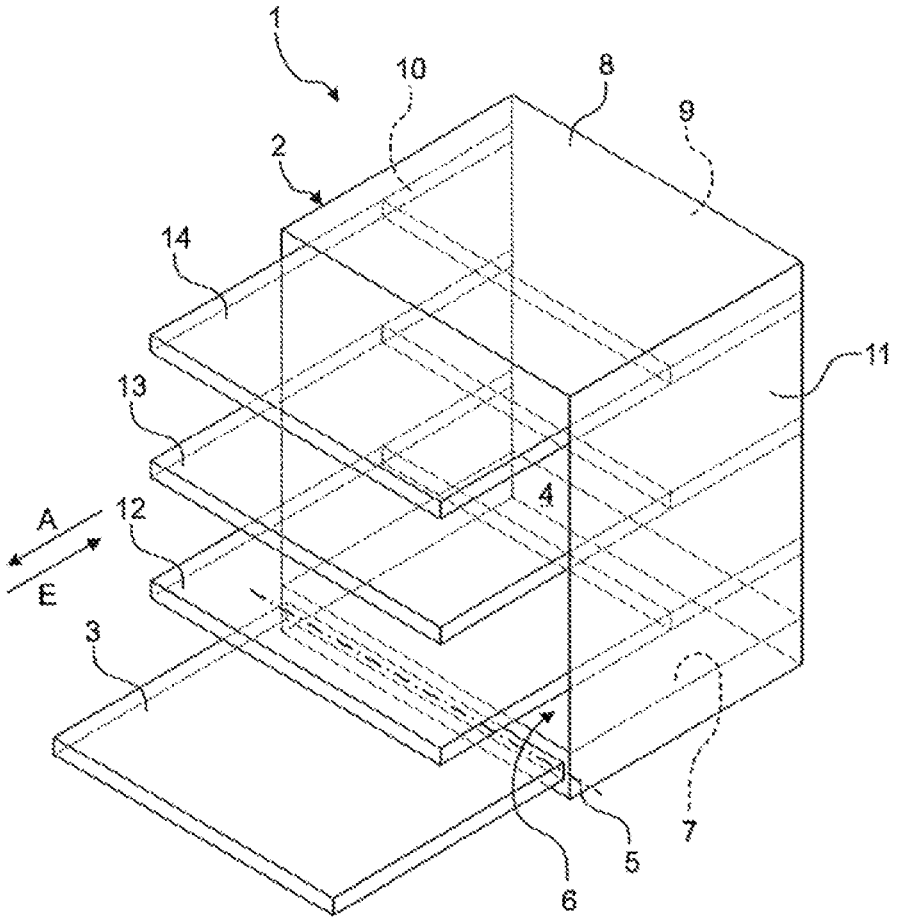
FIG. 1 shows a schematic perspective view of an embodiment of a household dishwasher.

Identical elements or those of identical function are shown with the same reference characters in the figures, unless otherwise specified.

FIG. 1 shows a schematic perspective view of an embodiment of a household dishwasher 1. The household dishwasher 1 comprises a washing container 2, which can be closed, in particular in a water-tight manner, by a door 3. To this end a sealing facility can be provided between the door 3 and the washing container 2. The washing container 2 is preferably box-shaped. The washing container 2 can be arranged in a housing of the household dishwasher 1. The washing container 2 and door 3 can form a washing chamber 4 for washing items to be washed.

The door 3 is shown in its opened position in FIG. 1. The door 3 can be closed or opened by pivoting about a pivot axis 5 provided at a lower end of the door 3. A loading opening 6 of the washing container 6 can be closed or opened with the aid of the door 3. The washing container 2 has a base 7, a top 8 arranged opposite the base 7, a rear wall 9 arranged opposite the closed door 3 and two opposing side walls 10, 11. The base 7, top 8, the rear wall 9 and side walls 10, 11 can be made of stainless steel sheet for example. Alternatively the base 7 for example can be made of a plastic material.

The household dishwasher 1 also has at least one receptacle 12 to 14 for items to be washed. A number of receptacles 12 to 14 for items to be washed, for example three, can preferably be provided, it being possible for the receptacle 12 for items to be washed to be a lower receptacle for items to be washed or a lower rack, the receptacle 13 for items to be washed to be an upper receptacle for items to be washed or an upper rack and the receptacle 14 for items to be washed to be a flatware drawer. As shown in FIG. 1, the receptacles 12 to 14 for items to be washed are arranged one above the other in the washing container 2. Each receptacle 12 to 14 for items to be washed can be moved into or out of the washing container 2 as required. In particular each receptacle 12 to 14 for items to be washed can be pushed into the washing container 2 in an insertion direction E and pulled out of the washing container 2 in a pull-out direction A counter to the insertion direction E.

Figure 2:
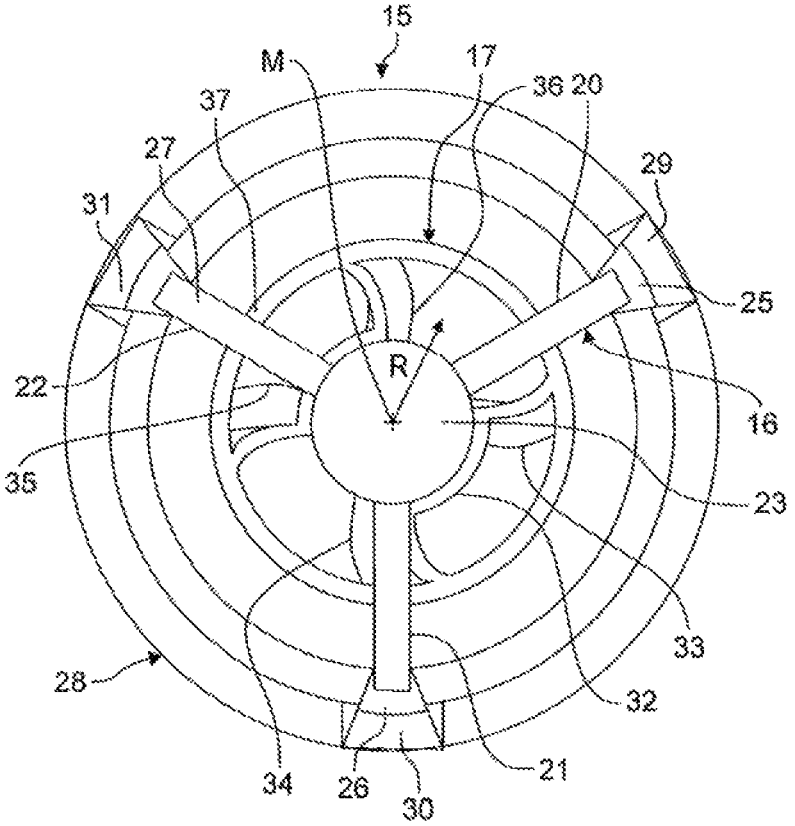
FIG. 2 shows a schematic view from above of an embodiment of a spray facility for the household dishwasher in FIG. 1.
Figure 3:
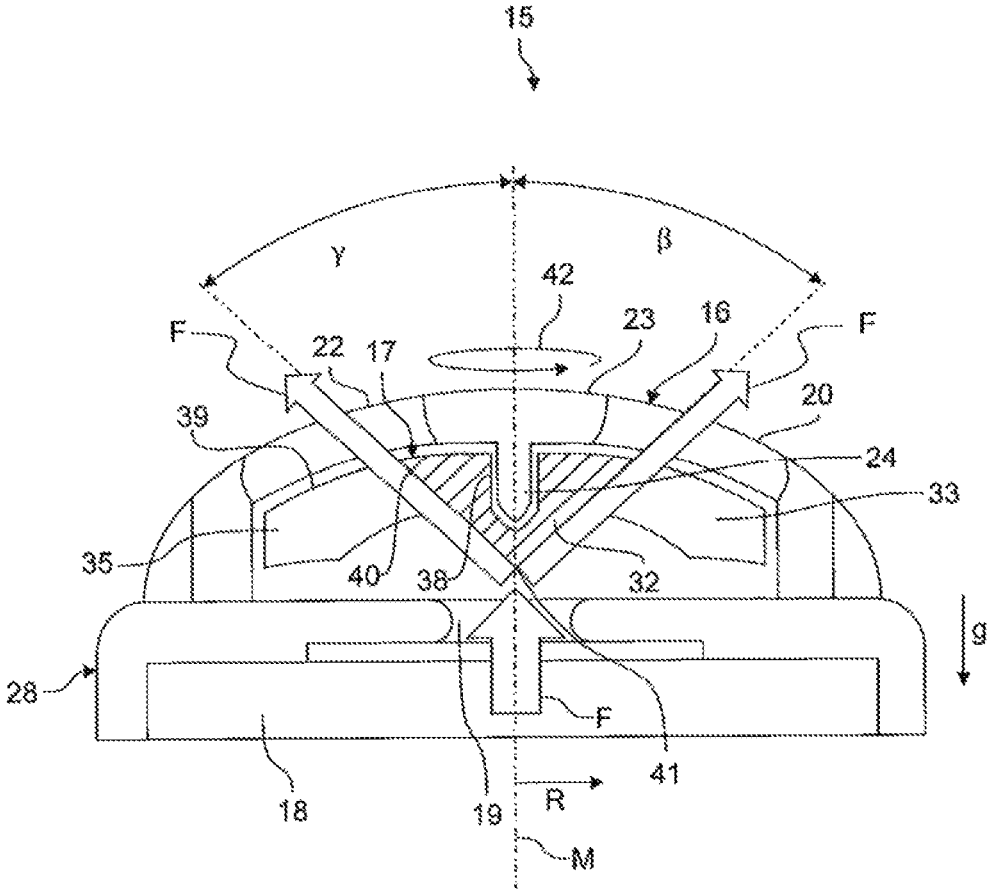
FIG. 3 shows a schematic sectional view of the spray facility in FIG. 2.
Figure 4:
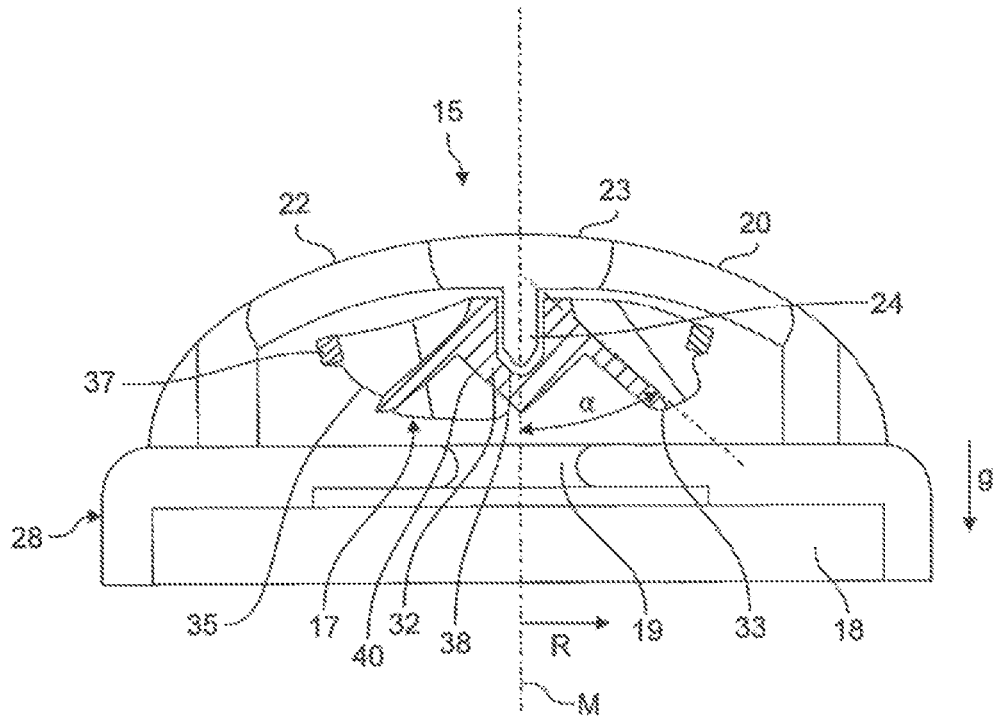
FIG. 4 shows a further schematic sectional view of the spray facility in FIG. 2.

FIG. 2 shows a schematic view from above of an embodiment of a spray facility 15 for the household dishwasher 1. FIGS. 3 and 4 each show a schematic sectional view of the spray facility 15. The spray facility 15 can be provided for example on the base 7 of one of the receptacles 12 to 14 for items to be washed or on spray arms (not shown) of the household dishwasher 1. A number of such spray facilities 15 are preferably provided. The spray facility 15 is designed to distribute and/or spray washing liquor and/or fresh water F within the washing container 2.

The spray facility 15 comprises a cage 16, a gyro element 17 rotatably supported in the cage 16 and a supply line 18 with a nozzle 19 for supplying the washing liquor and/or fresh water F to the gyro element 17. The gyro element 17 is shown in its respective operating position in FIGS. 3 and 4 (and in FIGS. 5 to 8). The cage 16 is preferably made of a plastic material. The cage 16 is an injection-molded plastic part for example. The cage 16 can be configured as a single piece with the supply line 18. In other words the cage 16 can comprise the supply line 18 or vice versa. The cage 16 comprises a number of bars 20 to 22, for example three, which are arranged in a regularly distributed manner around the bearing plate 23. The bearing plate 23 can be circular or have any other geometry.

The bearing plate 23 can be configured with rotational symmetry in relation to a rotation axis M of the gyro element 17. A bolt or axle 24 is provided on the lower face of the bearing plate 23, in other words facing the gyro element 17, the gyro element 17 being rotatably supported thereon. The bearing plate 23 is configured as a single piece with the axle 24. The bars 20 to 22 are preferably arranged in a regularly distributed manner around the rotation axis M. The bars 20 to 22 each have a fastening segment 25 to 27 on an end segment facing away from the bearing plate 23.

The fastening segments 25 to 27 can be connected in a fixed manner to a housing 28 of the spray facility 15. The fastening segments 25 to 27 are clipped or snapped into the housing 28 for example. The supply line 18 with the nozzle 19 can be provided in the housing 28. Holding segments 29 to 31 corresponding to the fastening segments 25 to 27 can be provided on the housing 28. The fastening segments 25 to 27 are connected with a form fit to the holding segments 29 to 31 for example. A form-fit connection results when at least two connecting partners, in this instance the fastening segments 25 to 27 and the holding segments 29 to 31, engage in or behind one another.

The cage 16, in other words the bars 20 to 22, are curved, in particular curved in the manner of a spherical cap. This gives the spray facility 15 a spherical cap-shaped geometry. A spherical cap, a spherical segment or a spherical section is part of a spherical body formed by a section with one plane. A spherical cap has the shape of a cupola and has a circular disk-shaped footprint.

As mentioned above, the supply line 18 with the nozzle 19 can be provided in the housing 28. The nozzle 19 is characterized in that it represents a narrowing of cross section compared with the supply line 18. This allows the washing liquor and/or fresh water F to flow out of the nozzle 19 and/or be sprayed with the aid of the nozzle 19 at high pressure. The nozzle 19 is preferably configured with rotational symmetry in relation to the rotation axis M. Alternatively the nozzle 19 can also be formed asymmetrically in relation to the rotation axis M and/or be arranged with an offset relative to it. However the nozzle 19 is preferably positioned centrally below the axle 24.

As shown in FIGS. 3 and 4, the gyro element 17 is arranged in its entirety above the nozzle 19 in relation to a direction of gravity g in its operating position. In other words the nozzle 19 is positioned in its entirety below the gyro element 17 in relation to the direction of gravity g. The direction of gravity g is the direction in which gravity acts. In the orientation in FIGS. 3 and 4 the direction of gravity g runs from top to bottom. In other words the washing liquor and/or fresh water F can be sprayed onto the gyro element 17 counter to the direction of gravity g with the aid of the nozzle 19.

The gyro element 17 comprises a hub 32 and a plurality of blades 33 to 36 connected to the hub 32. Four such blades 33 to 36 can be provided for example. When the gyro element 17 is supplied with the washing liquor and/or fresh water F, it can be made to rotate with the aid of the blades 33 to 36. Fewer than four, for example three, or more than four blades 33 to 36 can also be provided. The blades 33 to 36 can be angled at an angle of inclination a to the rotation axis M, as shown in FIG. 4. The angle of inclination a can be for example 20° to 60°, preferably 30° to 50°, more preferably 35° to 45°, more preferably 40°.

The blades 33 to 36 are also curved or rounded in an arched manner when viewed in a radial direction R of the gyro element 17. The radial direction R is oriented perpendicular to the rotation axis M and away from it. The blades 33 to 36 are in particular configured as a single material piece with the hub 32. For example the gyro element 17 can be an injected-molded plastic part. The blades 33 to 36 are connected to one another with the aid of a connecting ring 37 running around the gyro element 17.

A holding segment 38 for holding the axle 24 of the cage 16 is provided centrally in or on the hub 32. The dimensions of the axle 24 and the holding segment 38 are designed so that there is sufficiently large clearance between the axle 24 and the holding segment 38, so that rotational movement of the gyro element 17 is not impeded even if dirt particles collect between the axle 24 and the holding segment 38. The cage 16, in particular the axle 24 on the bearing plate 23, and the gyro element 17, in particular the holding segment 38 in the hub 32, are embodied such that in its rest position without the action of sprayed washing liquor and/or fresh water, the gyro element 15 initially rests on the housing 28 of the spray facility 15 due to gravity and is only pushed into its operating position shown in FIG. 3 counter to gravity by the force of the sprayed washing liquor and/or fresh water.

As shown in FIG. 3, the gyro element 17 has a curved outer contour 39, in particular one curved in the manner of a spherical cap, corresponding to the spherical cap-shaped geometry of the cage 16. The hub 32 is configured in particular with rotational symmetry in relation to the rotation axis M. In particular the hub 32 has a conical lateral surface 40 with a half taper angle or taper angle β. The taper angle β can be for example 30° to 60°, preferably 40° to 50°, more preferably 45°. The hub 32 is preferably conical and not shaped as a truncated cone and has a cone tip or tip 41. This directs the washing liquor and/or fresh water F away particularly effectively.

The functionality of the spray facility 15 is described in the following. Washing liquor and/or fresh water F is supplied to the nozzle 19 by way of the supply line 18 and sprayed onto the hub 32, which is arranged above the nozzle 19 in the direction of gravity g. The washing liquor and/or fresh water pressure applied to the gyro element 17 as a result and acting counter to gravity causes the gyro element 17 to rise from its rest position (not shown), in which it rests on the housing 28 of the spray facility 15, into its operating position as shown in FIGS. 3 to 8. The washing liquor and/or fresh water F is conducted away outward in the radial direction R over the conical lateral surface 40 of the hub and at least some is supplied to the blades 33 to 36. This causes the gyro element 17 to rotate, as shown in FIG. 3 with the aid of an arrow 42. The washing liquor and/or fresh water F is conducted away from the hub 32 at a spray angle γ, which may correspond to the taper angle β. The washing liquor and/or fresh water F is also distributed with the aid of the blades 33 to 36. This produces a hemispherical spray pattern around the spray facility 15, which can only have a dead zone in the region of the bearing plate 23. The spray pattern can be varied and/or adjusted by varying the taper angle β.

With embodiments of the spray facility, in which the gyro element 17 is held in its operating position by structural measures without the action of the washing liquor and/or fresh water pressure, there is of course no need for the gyro element 17 to be raised from its rest position into the operating position.

Figure 5:
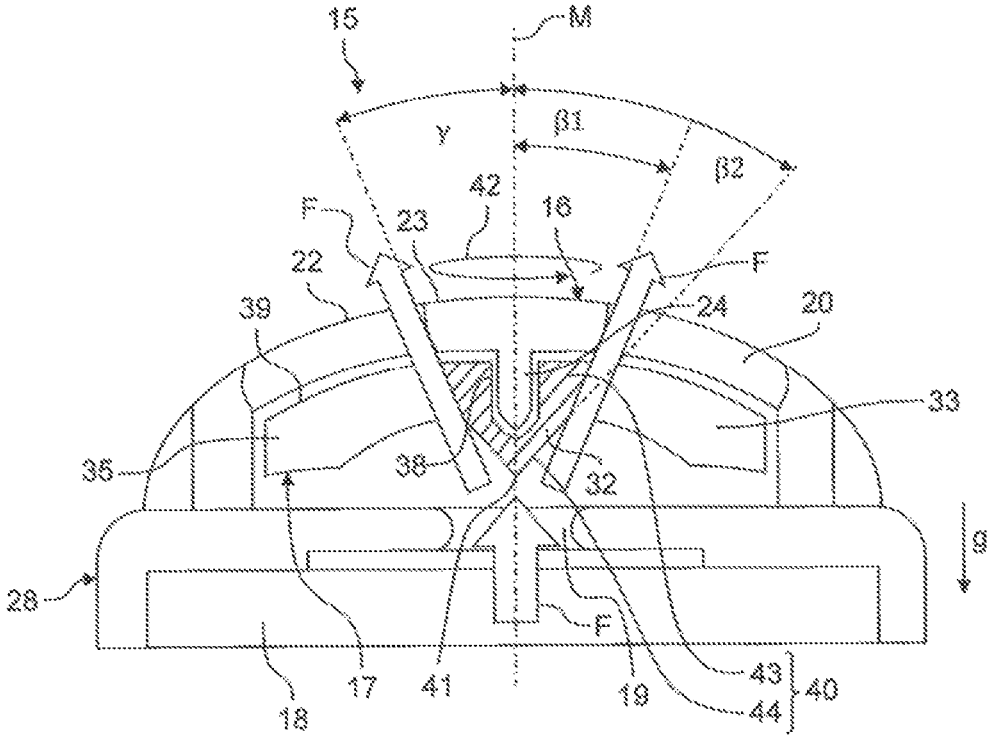
FIG. 5 shows a schematic sectional view of a further embodiment of a spray facility for the household dishwasher in FIG. 1.

FIG. 5 shows a schematic sectional view of a further embodiment of a spray facility 15. The embodiment of the spray facility 15 in FIG. 5 only differs from the embodiment of the spray facility 15 in FIGS. 2 to 4 in that the gyro element 17, in particular the hub 32 thereof, is configured in an alternative manner. The hub 32 has a lateral surface 40 configured with a number of steps, comprising for example a first lateral surface segment 43 and a second lateral surface segment 44. The lateral surface segments 43, 44 have different half taper angles or taper angles β1, β2. For example a first taper angle β1 of a first lateral surface segment 43 is smaller than a second taper angle β2 of a second lateral surface segment 44. The spray angle γ and therefore also the spray pattern of the spray facility 15 can be adjusted as required by varying the taper angles β1, β2.

Figure 6:
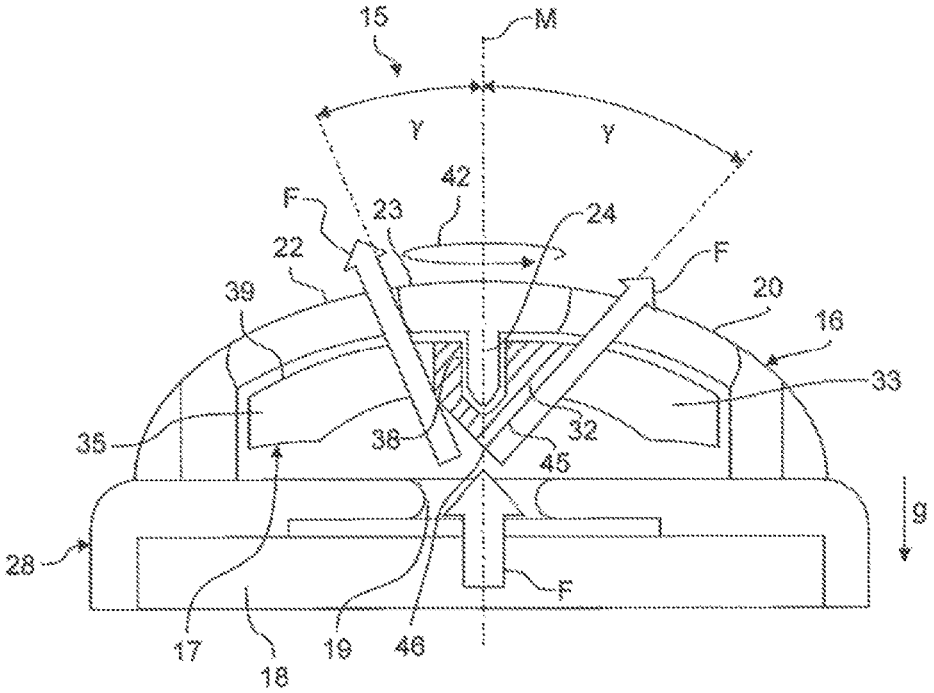
FIG. 6 shows a schematic sectional view of a further embodiment of a spray facility for the household dishwasher in FIG. 1.

FIG. 6 shows a schematic sectional view of a further embodiment of a spray facility 15. The spray facility 15 in FIG. 6 also only differs from the spray facility 15 in FIGS. 2 to 4 in that the gyro element 17, in particular the hub 32 thereof, is configured in an alternative manner. In this embodiment of the gyro element 17 the hub 32 of the gyro element 17 is not configured with rotational symmetry in relation to the rotation axis M but asymmetrically, in particular with rotational asymmetry. "Rotational asymmetry" here means the opposite of "rotational symmetry". In other words the hub 32 is not a body with rotational symmetry in relation to the rotation axis M, as set out above. This means that during operation of the household dishwasher 1 the spray angle γ always varies. In other words different spray angles γ can be generated. This allows a chaotic spray pattern to be achieved and therefore a particularly good cleaning result. A lateral surface 45 of the hub 32 can have any three-dimensional geometry. The hub 32 preferably comes to a point and comprises a tip 46 facing the nozzle 19.

Figure 7:
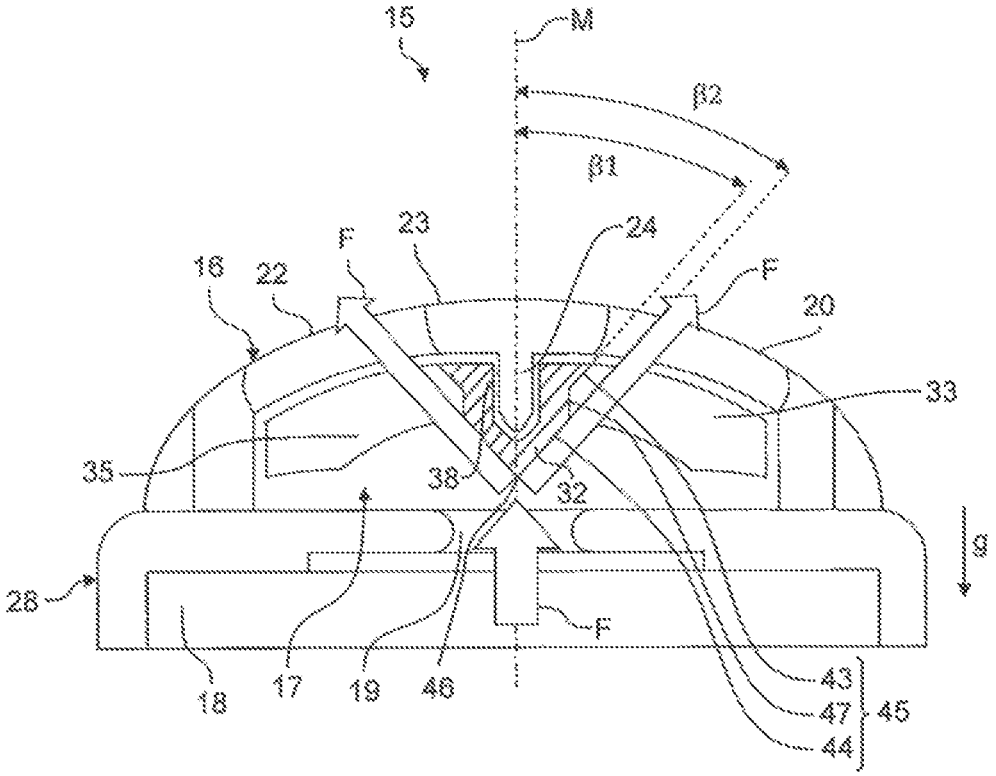
FIG. 7 shows a schematic sectional view of a further embodiment of a spray facility for the household dishwasher in FIG. 1.

FIG. 7 shows a schematic sectional view of a further embodiment of a spray facility 15. The spray facility 15 in FIG. 7 essentially differs from the spray facility 15 in FIGS. 2 to 4 in that the gyro element 17, in particular its hub 32, is configured in an alternative manner. In this embodiment of the spray facility 15, although the hub 32 of the gyro element 17 is configured with rotational symmetry in relation to the rotation axis M, said hub 32 is configured with a number of steps and comprises a lateral surface 40 configured with rotational symmetry in relation to the rotation axis M with a first conical lateral surface segment 43, a second conical lateral surface segment 44 and a circular cylinder-shaped third lateral surface segment 47 arranged between the first lateral surface segment 43 and the second lateral surface segment 44. The conical lateral surface segments 43, 44 preferably have different half taper angles or taper angles β1, β2. The taper angles β1, β2 can also be identical.

A freely definable spray pattern can be achieved according to the selected taper angles β, β1, β2 with the aid of the configuration of the hub 32 and blades 33 to 36. Different taper angles β, β1, β2 and/or an asymmetrical configuration of the hub 32 allow(s) a completely full hemispherical spray pattern to be generated around the spray facility 15.

Figure 8:
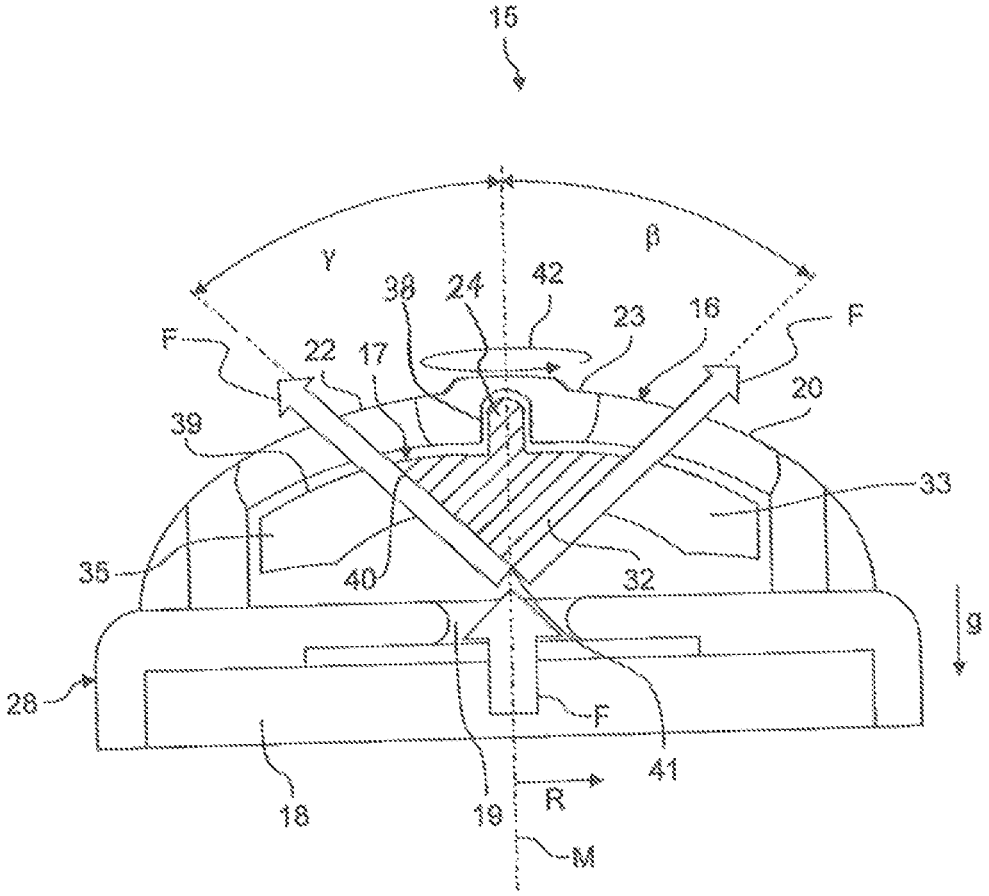
FIG. 8 shows a schematic sectional view of a further embodiment of a spray facility for the household dishwasher in FIG. 1.

FIG. 8 shows a schematic sectional view of a further embodiment of a spray facility 15. The spray facility 15 in FIG. 8 essentially differs from the spray facility 15 in FIG. 3 in that the gyro element 17 and bearing plate 23 are configured in an alternative manner, in particular in respect of the axle 24 and the holding segment 38 for the axle 24. In this embodiment of the spray facility 15 the bolt or axle 24 is not provided on the bearing plate 23 but on the top face, in other words facing the bearing plate 23, at the center of the hub 32 of the gyro element 17. The holding segment 38 for holding the axle 24 is therefore not provided on or in the hub 32 of the gyro element 17 but on or in the bearing plate 23. The dimensions of the axle 24 and the holding segment 38 here are in turn such that there is sufficiently large clearance between the axle 24 and the holding segment 38 so that rotational movement of the gyro element 17 is not impeded even if dirt particles collect between the axle 24 and the holding segment 38. To make the spray facility 15 as compact as possible, the bearing plate 23 and therefore the cage 16 can be of reduced material thickness in the region above the holding segment 38 (in relation to the direction of gravity) compared with the adjacent regions. Of course the modified support in FIG. 8 can also be applied in the embodiments in FIGS. 3 to 7.

The mode of operation of the spray facility 15 is visually clearly obvious for a user of the household dishwasher 1 and the added value of the spray facility 15 is easy to comprehend. The spray facility 15 is soiling-resistant due to a sufficiently large bearing clearance in the axial and radial directions and a sufficiently large bearing gap configuration between the axle 24 and the holding segment 38. Even if the gyro element 17 should be blocked, there is a highly effective fail-safe response, as the hub 32 alone distributes the washing liquor and/or fresh water F adequately. The spray facility 15 is compact and can therefore be positioned below the receptacles 12 to 14 for items being washed.

Although the present invention has been described based on exemplary embodiments, it can be modified in many different ways.

REFERENCE CHARACTERS USED

1 Household dishwasher
2 Washing container
3 Door
4 Washing chamber
5 Pivot axis
6 Loading opening
7 Base
8 Top
9 Rear wall
10 Side wall
11 Side wall
12 Receptacle for items to be washed
13 Receptacle for items to be washed
14 Receptacle for items to be washed
15 Spray facility
16 Cage
17 Gyro element
18 Supply line
19 Nozzle
20 Bar
21 Bar
22 Bar
23 Bearing plate
24 Axle
25 Fastening segment
26 Fastening segment
27 Fastening segment
28 Housing
29 Holding segment
30 Holding segment
31 Holding segment
32 Hub
33 Blade
34 Blade
35 Blade
36 Blade
37 Connecting ring
38 Holding segment
39 Outer contour
40 Lateral surface
41 Tip
42 Arrow
43 Lateral surface segment
44 Lateral surface segment
45 Lateral surface
46 Tip
47 Lateral surface segment
A Pull-out direction
E Insertion direction
F Washing liquor/fresh water
g Direction of gravity
M Rotation axis
R Radial direction
$\alpha$ Angle of inclination
$\beta$ Taper angle
$\beta 1$ Taper angle
$\beta 2$ Taper angle
$\gamma$ Spray angle

The invention claimed is:

1. A household dishwasher, comprising:

a washing container; and a spray facility arranged within the washing container for spraying washing liquor and/or fresh water in the washing container, said spray facility comprising a cage, a gyro element rotatably supported in the cage, and a supply line having a nozzle for supplying the washing liquor and/or fresh water to the gyro element, said gyro element being arranged in its entirety above the nozzle in relation to a direction of gravity in an operating position which the gyro element assumes when washing liquor and/or fresh water is supplied to the gyro element, wherein the nozzle is formed as an outlet of a housing of the spray facility, with the nozzle being positioned centrally with respect to an axis of rotation of the gyro element; and wherein the gyro element initially rests on the housing of the spray facility proximate to the nozzle due to gravity and is only pushed into an operation position counter to gravity by a force of the washing liquor and/or fresh water that is supplied to the gyro element.

2. The household dishwasher of claim 1, wherein a clearance between the nozzle and the gyro element in the operating position of the gyro element is at least 3 mm.

3. The household dishwasher of claim 1, wherein a clearance between the nozzle and the gyro element in the operating position of the gyro element is at least 4 mm.

4. The household dishwasher of claim 1, wherein a clearance between the nozzle and the gyro element in the operating position of the gyro element is at least 5 mm.

5. The household dishwasher of claim 1, wherein the cage includes a bearing plate, said gyro element including a hub and an axle extending from the hub, said axle being supported rotatably in a holding segment of the bearing plate of the cage.

6. The household dishwasher of claim 5, wherein the bearing plate has a region which is located above the holding segment in relation to the direction of gravity, said region of the bearing plate having a material thickness which is reduced compared to a material thickness of an adjacent region.

7. The household dishwasher of claim 1, wherein the supply line has precisely one said nozzle to spray the washing liquor and/or fresh water onto a center of the gyro element.

8. The household dishwasher of claim 1, wherein said gyro element assumes a rest position on condition that no washing liquor and/or fresh water is supplied to the gyro element.

9. The household dishwasher of claim 1, wherein the gyro element has an outer contour which is curved.

10. The household dishwasher of claim 9, wherein the outer contour of the gyro element is curved in a manner of a spherical cap.

11. The household dishwasher of claim 1, wherein the cage is curved.

12. The household dishwasher of claim 11, wherein the cage is curved in a manner of a spherical cap.

13. The household dishwasher of claim 1, wherein the gyro element includes a hub and blades connected to the hub, said hub being configured to supply the washing liquor and/or fresh water supplied to the hub via the supply line to the blades during operation of the household dishwasher.

14. The household dishwasher of claim 13, wherein the hub is configured with rotational symmetry in relation to a rotation axis of the gyro element and has a conical lateral surface.

15. The household dishwasher of claim 14, wherein the lateral surface is configured with a number of steps and has a number of lateral surface segments, which differ from one another in respect of their taper angles.

16. The household dishwasher of claim 13, wherein the hub is configured asymmetrically in relation to a rotation axis of the gyro element so that a spray angle of the spray facility varies during operation of the household dishwasher.

17. The household dishwasher of claim 13, wherein the blades are angled at an angle of inclination relative to a rotation axis of the gyro element.

18. The household dishwasher of claim 13, further comprising a connecting ring running around the gyro element, said blades being connected to one another via the connecting ring.

* * * * *